United States Patent [19]

Stutts

[11] Patent Number: 4,600,478

[45] Date of Patent: Jul. 15, 1986

[54] ELECTROSYNTHESIS OF SIX-MEMBERED HETEROCYCLIC ALCOHOLS

[75] Inventor: Kenneth J. Stutts, Midland, Mich.

[73] Assignee: The Dow Chemical Company, Midland, Mich.

[21] Appl. No.: 749,709

[22] Filed: Jun. 28, 1985

[51] Int. Cl.[4] ..... C25C 1/00

[52] U.S. Cl. ..... 204/59 R; 204/72; 204/77; 204/79

[58] Field of Search ..... 204/59 R, 72, 77, 79

[56] References Cited

U.S. PATENT DOCUMENTS

| | | | |
|---|---|---|---|
| 3,399,215 | 8/1968 | Brader | 260/340.6 |
| 4,459,411 | 7/1984 | Wang | 204/59 R |

OTHER PUBLICATIONS

Tatsuya Shono et al., *Nippon Kagaku Zasshi,* "Radical Reactions of Organic Compounds with Fenton Reagent", 81(8) (1960), pp. 1344–1346.

Kunetsov, N. V. and I. I. Krasavtsev, *Dopov. Akad. Nauk. Urk. RSR,* "Dioxin and its Reactions", Ser. B, 31(11) (1969), pp. 1016–1018.

Houser, John J. and Barbara A. Sibbio, *Journal of Organic Chemistry,* "Liquid Phase Photolysis of Dioxane", 42(12) (1977) pp. 2145–2151.

Shintani, Hiderau; Hiroshi Suzuki and Takuma Oba, *Eisei Kagaku,* "Qualitative and Quantitative Aspects of Ethylene Chlorohydrin, Ethylene Glycol and Other Reaction Products of Ethylene Oxide in Saline During the Prolonged Incubation", 27(5) (1981) pp. 285–295.

Meites, L.; "Technique of Organic Chemistry", A. Weissburger–Ed., vol. 1, 3rd Edition, p. 3281, Interscience, N.Y. (1959).

*Chemical Engineer's Handbook,* 5th Edition, pp. 23–39 (1973).

Chemical Abstract 56:298f.

Chemical Abstract 72:43580t.

Chemical Abstract 86:43631z.

Chemical Abstract 87:23172t.

Chemical Abstract 96:110100x.

*Primary Examiner*—R. L. Andrews

[57] ABSTRACT

Substituted organic diols such as diethylene glycol can be oxidized in an electrochemical cell to form a six-member heterocyclic alcohol, such as 1,4-dioxan-2-ol. The six-member heterocyclic alcohols are useful as solvents for pharmaceuticals.

30 Claims, No Drawings

ELECTROSYNTHESIS OF SIX-MEMBERED HETEROCYCLIC ALCOHOLS

BACKGROUND OF THE INVENTION

This invention relates to the electrosynthesis of cyclic alcohols.

Cyclic alcohols are useful solvents. They are particularly useful as solvents for pharmaceuticals.

1,4-Dioxanol has been produced by mixing water and dioxane then adding hydrogen peroxide and ferrous sulfate. Tatsuya Shono et al., *Nippon Kagaku Zasshi,* "Radical Reactions of Organic Compounds with Fenton Reagent", 81(8) (1960) pp. 1344–1346 (translation).

1,4-Dioxanol has also been prepared by adding chloro-1,4-dioxane to a water suspension of sodium bicarbonate. N. V. Kunetsov and I. I. Krasavtsev, *Dopov. Akad. Nauk. Urk. RSR,* "Dioxin and its Reactions", Ser. B, 31(11) (1969) pp. 1016–1018. (Translation p. 6).

1,4-Dioxanol is also taught to be one of numerous photolysis products of dioxane. John J. Houser and Barbara A. Sibbio, *Journal of Organic Chemistry,* "Liquid Phase Photolysis of Dioxane", 42(12) (1977) pp. 2145–2151.

1,4-Dioxanol has also been identified as a by-product of a toxicity study for ethylene oxide. Hiderau Shintani, Hiroshi Suzuki and Takuma Oba, *Eisei Kagaku,* "Qualitative and Quantitative Aspects of Ethylene Chlorohydrin, Ethylene Glycol and Other Reaction Products of Ethylene Oxide in Saline During the Prolonged Incubation", 27(5) (1981) pp. 285–295 (translation).

U.S. Pat. No. 3,399,215, column 2, lines 3–16, teaches that the dehydration of diethylene glycol to p-dioxanone is believed to proceed through an intermediate, 1,4-dioxanol. The reference also teaches that the dehydration of secondary alcohols is known to proceed faster than the dehydration of primary alcohols. Therefore, the intermediate 1,4-dioxanol is not isolated.

None of these processes produce 1,4-dioxanols from inexpensive raw materials in reasonable yields. It is therefore desirable to have a process for producing cyclic alcohols and cyclic ketones from inexpensive raw materials in relatively high yields.

SUMMARY OF THE INVENTION

The present invention is a process for electrosynthesizing a six-membered heterocyclic alcohol. This process comprises subjecting an organic diol, in contact with an electrolyte, to an electrical potential sufficient to produce the six-membered heterocyclic alcohol. The organic diol is represented by the formula:

$$HOCH_2RCH_2OH$$

wherein R is a divalent organic moiety having a three-membered chain bonded at each end to one of the $—CH_2OH$ moieties.

The diols used to prepare the heterocyclic alcohols are relatively inexpensive. The resulting heterocyclic alcohols are useful as solvents for pharmaceuticals and other organic compounds.

DETAILED DESCRIPTION OF THE INVENTION

The organic diols employed in the practice of this invention are preferably those in which R is $—CH_2CH_2CH_2—$, $—CH_2OCH_2—$, $—CH_2SCH_2$, $$—CH_2\overset{H}{\overset{|}{N}}CH_2—,\ —CH_2\overset{O}{\overset{\|}{C}}CH_2—,\ —CH_2\overset{O}{\overset{\|}{S}}CH_2—,$$

and the like; with diols wherein R is $—CH_2OCH_2—$ being most preferred. Suitable diols include those wherein R bears one or more unreactive substituents, e.g., alkyl, alkoxy, aryl, halo, haloalkyl, haloaryl and haloalkoxy. By "unreactive substituent", it is meant that the substituent does not react and does not significantly interfere with the formation of the heterocyclic alcohol. Examples of such diols include diethylene glycol, 1,5-pentanediol, bis(hydroxyethyl)sulfide, N,N-di(ethanol-)amine, bis(hydroxyethyl)ketone and bis(hydroxyethyl)sulfoxide. Of the foregoing examples, diethylene glycol is most preferred. The diols are either commercially available or are readily prepared by conventional organic synthesis.

While the present invention can be carried out in any liquid medium capable of conducting an electrical current, it is preferable to conduct the reaction in an aqueous solution containing an electrolyte as well as the aforementioned diol. For purposes of this invention, an electrolyte is a material which disassociates to form a sufficient concentration of ions to enable the solution to conduct the desired electrical current. More preferred are electrolytes which, when dissolved in water, provide an aqueous solution having a pH greater than about 8, most preferably a pH from about 9 to about 14. Examples of such more preferred electrolytes include the hydroxides and salts of the alkali metal, and ammonium ions, including quaternary ammonium ions. These include the hydroxides and carbonates of sodium, potassium, ammonium, tetraethyl ammonium, tetramethyl ammonium and other tetraalkyl ammonium ions.

Preferred aqueous solutions of electrolytes contain sufficient electrolytes to provide the solution with a conductivity from about $10^{-3}$ mho/cm to about $10^{-1}$ mho/cm, most preferably from about $10^{-3}$ mho/cm to about $10^{-1}$ mho/cm. Typically, a solution greater than about 0.1 molar concentration of an alkali metal hydroxide or alkali metal salt will have the desired conductivity. As an alternative to water, it is understood that other polar liquids can be used as the reaction medium. Such polar liquids include dimethylformamide; hexamethyl phosphoramide; dioxane; acetonitrile; propionitrile; acetic acid; and mixtures of such liquids.

It is also understood that the reaction may be carried out neat. The electrolytes, in such case, need to be soluble in the diol. Such electrolytes include quaternary ammonium hydroxides such as ammonium hydroxide, tetramethyl ammonium hydroxide, tetraethyl ammonium hydroxide, tetrabutyl ammonium hydroxide, and the like.

The concentration of the diol in the reaction mixture is suitably any amount which permits the formation of the desired heterocyclic alcohol in acceptable yields and rates of conversion. Preferably, however, the reaction mixture contains from about 0.01 to about 100 weight percent of the diol, most preferably from about 5 to about 15 weight percent.

The anode potential may be maintained at a selected value or may be varied; the only requirement being that the anode potential is sufficient to oxidize the diol. The former instance is referred to as controlled-potential electrolysis and is described by L. Meites in "Technique of Organic Chemistry", A. Weissberger-Editor, Vol. 1, 3rd Edition, page 3281, Interscience, N.Y. (1959). Typical anode potentials are about 0.5 volts versus silver, silver chloride reference electrode. The driving potential (electrical potential between the anode and cathode) is a direct voltage source, such as a battery, and is maintained constant while the cathode potential varies to some equilibrium value. Alternatively, a constant current source may be employed.

An electrochemical cell is a container which contains the reactive mixture into which at least two electrodes have been placed. The container may be constructed out of any material which will contain the reactive solution and not interfere with the electrosynthesis process. All portions of the cell which come in contact with the reacting mixture should preferably be resistant to basic aqueous solutions. More preferred are cells constructed of glass, Lucite, graphite and other mateials commonly used in similar cells. The cells described in U.S. Pat. No. 4,488,944 can be used in practicing this invention.

While any operative electrode can be used, preferred are nickel-based iron electrodes, cobalt-based iron electrodes, nickel electrodes, cobalt electrodes and electrodes containing alloys of nickel or cobalt. More preferred electrodes have 90 to 75 mole percent iron and 5 to 20 mole percent nickel or cobalt. Most preferred are type 304 stainless steel electrodes. Type 304 stainless steel is described on pp. 23–39 of *Chemical Engineer's Handbook,* 5th edition, 1973. While each electrode may be constructed of different materials, preferred are electrodes constructed of the same material. Preferred cells will contain 2 preferred electrodes, a reference electrode, a stirring means, a means for removing evolved $H_2$ gas from the cell, a pair of electrical leads to connect an electrical source to the electrodes and a means for charging and discharging the cell. While direct current is preferred, low frequency alternating current can be utilized in practicing this invention.

While any amount of oxidation will produce six-membered heterocyclic alcohols, preferred are oxidations where the charge passed through the solution is equal to between 0.85 and 2.93 times the theoretical charge of two electrons per molecule. Even more preferred are processes where the oxidation occurs such that between about 1 and about 2.1 times the theoretical charge has passed through the solution. Most preferred is the process where approximately 1.3 times the theoretical charge has passed through the solution. Charge is the time integral of electrical current flow. Multiplying average current flow by elapsed time yields the charge passing in the elapsed time. A Coulometer directly measures the time integral of current which is the charge passed through the circuit which contains the Coulometer.

The electrochemical cell may be operated at any suitable temperature. Preferred are temperatures below about 100° C. More preferred are temperatures below about 60° C. Preferred are temperatures above about 0° C. More preferred are temperatures above about 15° C.

While the reaction does not require a given atmosphere, the cathode reduces water to hydrogen and hydroxide ion. Therefore, an unreactive sweep gas such as nitrogen is preferably employed to reduce any explosion hazard.

Preferred conversions of diols are above about 30 percent, more preferred above about 50 percent. Preferred yields of six-membered heterocyclic alcohols are above about 30 percent, more preferred above about 40 percent, even more preferred above about 55 percent.

After the oxidation has been completed, the six-membered heterocyclic alcohols can be separated by known techniques. Preferred is the extraction with organic solvents such as carbon tetrachloride, which can be evaporated from the six-membered heterocyclic alcohols.

The six-member heterocyclic alcohols have the same substitution as the diols from which the six-membered heterocyclic alcohols are formed. Thus, diols of the formula $HOCH_2RCH_2OH$ produce six-membered heterocyclic alcohols of the formula

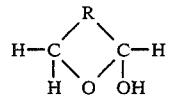

in which R is as previously defined. Diethylene glycol produces 2-dioxanol.

This invention is further described by the nonlimiting specific embodiments which follow.

SPECIFIC EMBODIMENT 1

A 2.321-g protion (0.0219 moles) of diethylene glycol and 50 milliliters of 2 molar (M) NaOH are added to a glass beaker cell containing a 304 stainless steel mesh anode, with a surface area of approximately 40 square centimeters in a concentric cathode with a surface area of approximately 50 square centimeters. A constant current of about 0.875 amps (A) is passed through the solution and aliquots of 0.175 milliliters are taken at various times for analysis in a liquid chromatograph. The reaction temperature is approximately 22° C. The results of the analysis are shown in Table I. The reaction is stopped after 2.93 times the theoretical charge is passed through the solution. The reaction solution is then acidified with hydrochloric acid to a pH of 0.75. The solution is then extracted three times with 50 milliliter aliquots of carbon tetrachloride. The carbon tetrachloride layer is concentrated by flash evaporation. The chemical structure of the product is determined by gas chromatography-mass spectroscopy.

Q represents the actual current passed through the cell. $Q_t$ represents the theoretical charge required to convert diethylene glycol to 2-dioxanol (2 electrons per molecule). The yield is based on diethylene glycol. The current efficiency is calculated as percent yield 2-dioxanol/(Q/Qt).

TABLE I

| Q/Qt | Conversion of diethylene glycol | % Yield 2-dioxanol | Current Efficiency | % Yield Diglycolic Acid |
|---|---|---|---|---|
| 0.85 | 49 | 32 | 38 | 0 |
| 1.31 | 60 | 51 | 39 | 0 |
| 2.16 | 93 | 61 | 28 | 12 |
| 2.93 | 100 | 53 | 18 | 24 |

The reduction of the percent yield as the reaction proceeds may be due to the electrochemical oxidation of the 2-dioxanol product. The maximum percent yield is at a $Q/Q_t$ of about 2.16.

SPECIFIC EMBODIMENT 2

A 2.2154-g portion (0.0209 mole) of diethylene glycol and 40 milliliters of 2 M NaOH are added to a glass beaker cell containing a type 304 stainless steel anode with a surface area of approximately 26 square centimeters. The cell also contains a type 304 stainless steel cathode with a square area of approximately 84 square centimeters. A constant potential of 0.45 volt versus a silver/silver chloride electrode is applied. Liquid chromatography reveals a substantial quantity of a material having a gas chromatograph retention time that is consistent with 1,4-dioxan-2-ol. This material is reduced to diethylene glycol by sodium borohydride to confirm that composition of the material is 1,4-dioxan-2-ol.

SPECIFIC EMBODIMENT 3

Example 2 is repeated with a constant applied current of 0.5 A. The area of the liquid chromatographic peak assigned to 1,4-dioxan-2-ol grows with a concurrent decrease in the area of the liquid chromatographic peak assigned to diethylene glycol as current flows through the electrochemical cell. After prolonged electrolysis (42,018 Coulombs) a significant portion of the 1,4-dioxan-2-ol is converted to diglycolic acid.

I claim:

1. A process for producing a six-membered heterocyclic alcohol comprising subjecting an organic diol, in contact with an electrolyte, to electrical potential sufficient to product the six-membered heterocyclic alcohol, wherein the organic diol is represented by the formula:

$$HOCH_2RCH_2OH$$

wherein R is a divalent organic moiety having a three-membered chain bonded at each end to one of the $—CH_2OH$ moieties.

2. The process of claim 1 wherein R bears one or more unreactive substituents.

3. The process of claim 2 wherein the unreactive substituents are independently selected from the group consisting of alkyl, alkoxy, aryl, halo, haloalkyl, haloaryl and haloalkoxy.

4. The process of claim 1 wherein the diol is selected from the group consisting of diethylene glycol, 1,5-pentanediol, bis(hydroxyethyl)sulfide, N,N-di-(ethanol)amine and bis(hydroxyethyl)ketone.

5. The process of claim 1 wherein the diol is diethylene glycol.

6. The process of claim 1 in which R is a divalent radical selected from the group $—CH_2CH_2CH_2—$, $—CH_2OCH_2—$, $—CH_2SCH_2$, $$—CH_2\overset{H}{\overset{|}{N}}CH_2—,\ —CH_2\overset{O}{\overset{\|}{C}}CH_2—,\ \text{and}\ —CH_2\overset{O}{\overset{\|}{S}}CH_2—.$$

7. The process of claim 2 in which R is the divalent moiety $—CH_2OCH_2—$.

8. The process of claim 1 in which the organic diol and electrolyte are subjected to an electric potential in an aqueous reaction medium.

9. The process of claim 8 in which the aqueous solution possesses a pH greater than about 8.

10. The process of claim 9 in which the aqueous solution possesses a pH from about 9 and about 14.

11. The process of claim 8 in which the electrolyte is selected from the group consisting of the hydroxides and salts of the alkali metal, alkaline earth and quaternary ammonium ions.

12. The process of claim 11 in which the solution has a conductivity of from about $10^{-3}$ to about $10^{-1}$ mhos/cm.

13. The process of claim 12 in which the electrolyte selected from the group consisting of the hydroxides and carbonates of sodium, potassium, ammonium, tetraalkyl ammonium and tetramethyl ammonium ions.

14. The process of claim 1 in which the organic diol and electrolyte are subjected to the electrical potential.

15. The process of claim 1 in which the organic diol and electrolyte are subjected to an electrical potential in a nonaqueous reaction medium.

16. The process of claim 15 in which the nonaqueous reaction medium is dimethylformamide; hexamethyl phosphoramide; dioxane; acetonitrile; propionitrile; acetic acid; or mixtures thereof.

17. The process of claim 1 in which the reaction mixture contains from about 0.01 weight percent through about 100 weight percent diol.

18. The process of claim 17 in which the reaction mixture contains from about 5 weight percent through about 15 weight percent diol.

19. The process of claim 1 in which the electrical potential is applied across a pair of electrodes.

20. The process of claim 19 in which the electrodes are constructed of the same material.

21. The process of claim 20 in which the electrodes are selected from the group consisting of nickel-based iron electrodes, cobalt-based iron electrodes, nickel electrodes, cobalt electrodes and electrodes containing alloys of nickel or cobalt.

22. The process of claim 21 in which the electrodes are selected from the group of electrodes having 90 to 75 mole percent iron and 5 to 20 mole percent nickel or cobalt.

23. The process of claim 22 in which the electrodes are type 304 stainless steel.

24. The process of claim 1 in which the charge passed through the solution is from about 0.85 and through 2.93 times the theoretical charge of two electrons per molecule.

25. The process of claim 24 in which the charge passed through the solution is about 1.3 times the theoretical charge of two electrons per molecule.

26. The process of claim 1 in which the subjection occurs at a temperature between about 100° C. and about 0° C.

27. The process of claim 1 in which an unreactive sweep gas is employed.

28. The process of claim 27 in which the sweep gas is nitrogen.

29. The process of claim 1 in which the conversion of diol is from about 30 percent through about 100 percent.

30. The process of claim 1 in which the yield based on diol is above about 30 percent.

* * * * *